US007303238B1

(12) United States Patent
Remus et al.

(10) Patent No.: US 7,303,238 B1
(45) Date of Patent: Dec. 4, 2007

(54) MINE SCALING VEHICLE

(75) Inventors: David H. Remus, Crystal Falls, MI (US); Stephen A. Rudinec, Iron Mountain, MI (US)

(73) Assignee: Oldenburg Group Incorporated, Glendale, WI (US)

( * ) Notice: Subject to any disclaimer, the term of this patent is extended or adjusted under 35 U.S.C. 154(b) by 0 days.

(21) Appl. No.: 11/132,878

(22) Filed: May 19, 2005

Related U.S. Application Data

(60) Provisional application No. 60/572,596, filed on May 19, 2004.

(51) Int. Cl.
*E21B 1/00* (2006.01)

(52) U.S. Cl. ..... 299/69

(58) Field of Classification Search ..... 299/32, 299/43, 37.3, 64, 69, 65, 70, 67, 95; 180/89.12, 180/89.13; 37/466, 443; 414/687, 694; 212/231, 232; 296/190.04
See application file for complete search history.

(56) References Cited

U.S. PATENT DOCUMENTS 4,102,461 A * 7/1978 Soyland ..... 414/694
4,147,262 A * 4/1979 Umeda et al. ..... 414/687
4,797,060 A * 1/1989 Kishi et al. ..... 414/687
5,158,189 A 10/1992 Watson et al.
5,265,995 A * 11/1993 Beck ..... 414/694
5,407,252 A 4/1995 Perero
5,711,095 A * 1/1998 Oda et al. ..... 37/410
6,009,643 A * 1/2000 Maeba et al. ..... 37/443

FOREIGN PATENT DOCUMENTS

JP 57165535 * 10/1982
JP 2-308016 * 12/1990

OTHER PUBLICATIONS

Sales Brochure "Gradall XL5110 Mine Scaler"; Gradel, Mar. 28, 2004.
Sales Brochure "Fletcher, Model 326ORD High Reach Scaler"; Fletcher Mining Equipment, Mar. 28, 2004.

* cited by examiner

*Primary Examiner*—Sunil Singh
(74) *Attorney, Agent, or Firm*—Reinhart Boerner Van Deuren s.c.

(57) ABSTRACT

A mine scaling vehicle for use in removing loose materials from the roof and walls of underground mines includes an articulated frame with a turntable mounted on a forward portion of the frame and a drive system mounted on the back portion of the frame. The turntable rotatably supports an operators cab and a boom carrying a scaling pick, with the operators cab being located centered rearwardly of the boom to provide improved scaling visability for the operator. The drive system and a hydraulic control system of the mine scaling vehicle are mounted on the frame located below a plane of the turntable to provide a low center of gravity of the mine scaling vehicle.

18 Claims, 11 Drawing Sheets

MINE SCALING VEHICLE

CROSS REFERENCE TO RELATED APPLICATION

This application claims priority of provisional application Ser. No. 60/572,596, which is entitled "Mine Scaling Vehicle", and which was filed on May 19, 2004, the entirety of which is hereby incorporated herein by reference.

BACKGROUND OF THE INVENTION

Field of the Invention

The present invention relates generally to mining implements, and more particularly, to a scaling vehicle for use in scaling or flaking operations involved with the removal of loose materials from mine ceilings and walls in underground mines.

To prevent accidents from falling debris mine personnel routinely remove loose materials, commonly referred to as scales, from the roof and walls of mines through an operation called "scaling". In the past, scaling has been done manually. However, in recent years, scaling has been carried out using mechanized equipment that includes extendable boom cranes with hydraulically operated "picks" or pneumatic hammers.

Mechanized boom scalers are commercially available from Gradall of New Philadelphia, Ohio as model #XL 5110 Mine Scaling Vehicle and from Fletcher Mining Equipment of Huntington, W. Va., as model #3250 RD Mine Scaling Vehicle, for example. These known mechanized boom scalers have the operator's cab located at one side of the boom at the front or at the rear of the vehicle. This affects the "pick" visibility for the operator. In addition, locating the operator's cab at one side of the boom requires the operator to move around to get a better view, which can result in operator discomfort in operation of the mine scaling vehicle. Moreover, in most known boom scalers, the major operating components of the vehicle, such as the vehicle engine and transmission, the supply and control components of the hydraulic control unit, and the operator's cab and the boom, are mounted on a common platform and pivot as a unit. This results in a relatively high center of gravity for the vehicle.

It is accordingly the primary objective of the present invention that it provide an improved mine scaling vehicle for use in removing loose materials from the roof and walls of underground mines.

Another objective of the invention is that it provide a mine scaling vehicle that affords improved pick visibility for the operator and provides improved comfort for an operator of the mine scaling vehicle.

A further objective of the invention is that it provide a mine scaling vehicle that provides mine face coverage with a mine scaling tool on the end of the boom.

A further objective of the invention is that it provide a mine scaling vehicle that is characterized by a low center of gravity, resulting in increased stability and ease of maneuverability.

The apparatus of the present invention must also be of construction which is both durable and long lasting, and it should also require little maintenance to be provided by the user throughout its operating lifetime. In order to enhance the market appeal of the apparatus of the present invention, it should also be of inexpensive construction to thereby afford it the broadest possible market. Finally, it is also an objective that all of the aforesaid advantages and objectives be achieved without incurring any substantial relative disadvantage.

SUMMARY OF THE INVENTION

The disadvantages and limitations of the background art discussed above are overcome by the present invention. With this invention, there is provided a mine scaling vehicle for use in removing loose materials from the roof and walls of underground mines.

In accordance with the invention, a mine scaling vehicle includes a frame, a turntable rotatably mounted on the frame, a boom coupled to the turntable and rotatable with the turntable, and a tool is coupled to the boom. A cab, from which an operator controls the operation of the mine scaling vehicle and the tool, is mounted on the turntable and rotatable with the turntable. The cab is located centered rearwardly of the boom to improve scaling visibility for the operator.

Further in accordance with the invention, a mine scaling vehicle includes a frame, a hydraulic control system mounted on the frame, and a turntable rotatably mounted on the frame. A boom is pivotally coupled to the turntable and rotatable with the turntable, and a tool is coupled to the boom. A cab, from which an operator controls the operation of the mine scaling vehicle and the tool, is mounted on the turntable and rotatable with the turntable. The hydraulic control system is coupled to the turntable for rotating the turntable, the cab and the boom relative to the frame and the hydraulic control system.

In accordance with a further aspect of the invention, a mine scaling vehicle includes a mobile articulated frame supported for movement by a transport mechanism, a drive system coupled to the transport mechanism for moving the vehicle. A turntable is mounted on the frame and includes a swing mechanism for rotating the turntable relative to the frame. A boom is pivotally coupled to the turntable and rotatable with the turntable and a tool is coupled to the boom. A cab, from which an operator controls the operation of the mine scaling vehicle and the tool, is mounted on the turntable and rotatable with the turntable. A hydraulic control system including at least one, and preferably two hydraulic actuators, is coupled to the swing mechanism for rotating the turntable relative to the frame. The drive system and the hydraulic control system are mounted on the frame located to provide a low center of gravity for the mine scaling vehicle.

Thus, the mine scaling vehicle provided by the invention includes a boom and an operator's cab that are rotatably mounted on a rotation bearing on the front half of the vehicle. The operator's cab is centered behind the boom for improved scaling pick visibility. Such location also improves operator comfort in operation of the mine scaling vehicle. The boom and operator's cab are rotatable, for example ±45°, each side from the centerline of the mine scaling vehicle. The boom carries a pick that is rotatable axially 270°, for example, and that can be moved forwardly and rearwardly.

The frame can be articulated and include a front frame section and a rear frame section. The turntable, the boom, the cab and a hydraulic control system can be located on the front frame section, and a drive system for the vehicle can be mounted on the rear frame section. Major machine components, such as the engine, the transmission, the operating and supply components of the hydraulic system, etc., remain static. The mounting arrangement for components of the mine scaling vehicle affords a low center of gravity resulting in ease of maneuverability of the mine scaling vehicle.

The mine scaling vehicle of the present invention is of a construction which is both durable and long lasting, and which will require little maintenance to be provided by the user throughout its operating lifetime. The mine scaling vehicle of the present invention is also of inexpensive construction to enhance its market appeal and to thereby afford it the broadest possible market. Finally, all of the aforesaid advantages and objectives are achieved without incurring any substantial relative disadvantage.

DESCRIPTION OF THE DRAWINGS

These and other advantages of the present invention are best understood with reference to the drawings, in which.

DETAILED DESCRIPTION OF THE PREFERRED EMBODIMENT

Figure 1:
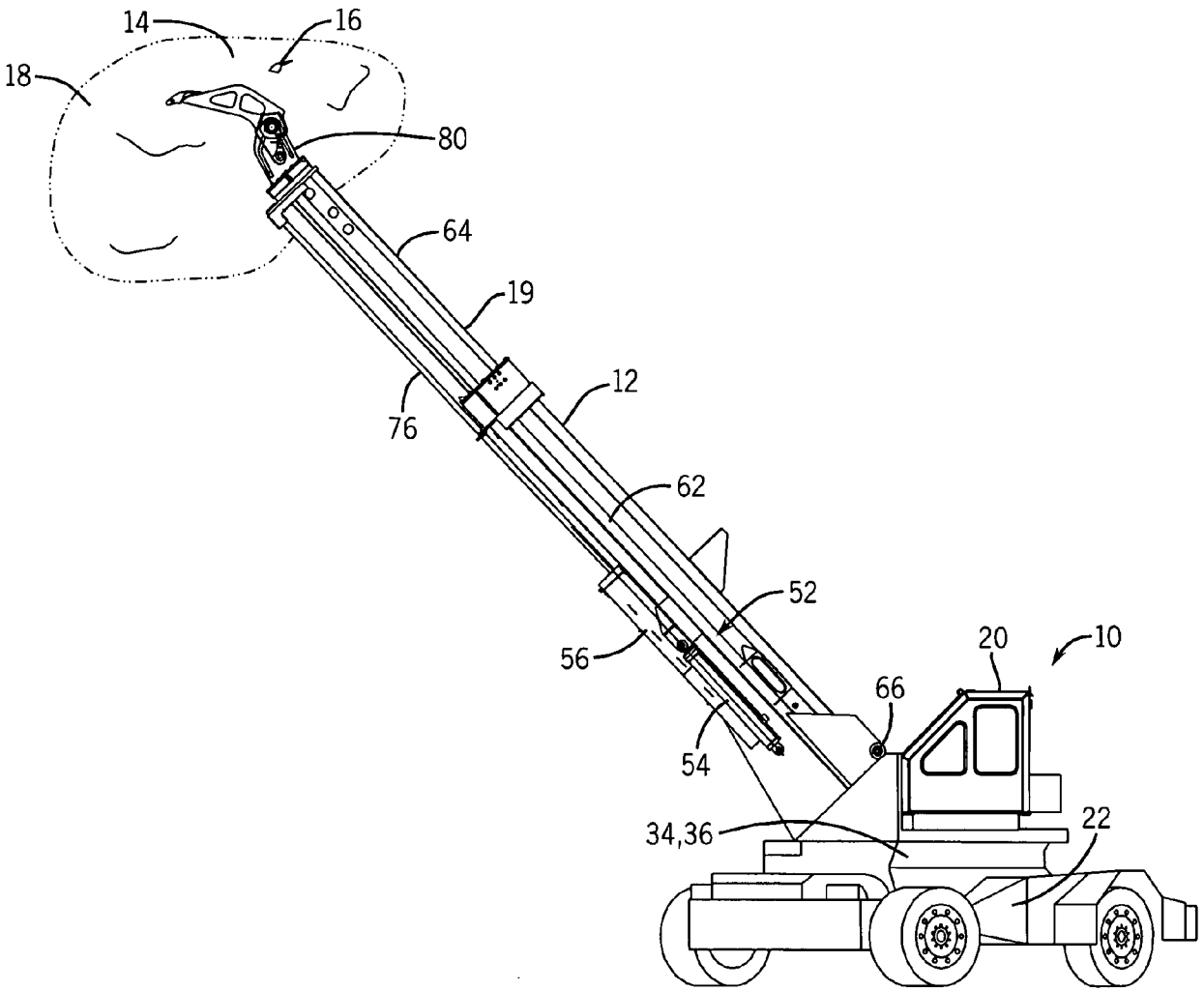
FIG. 1 is a view of the mine scaling vehicle provided by the present invention shown located within a mine.
Figure 2:
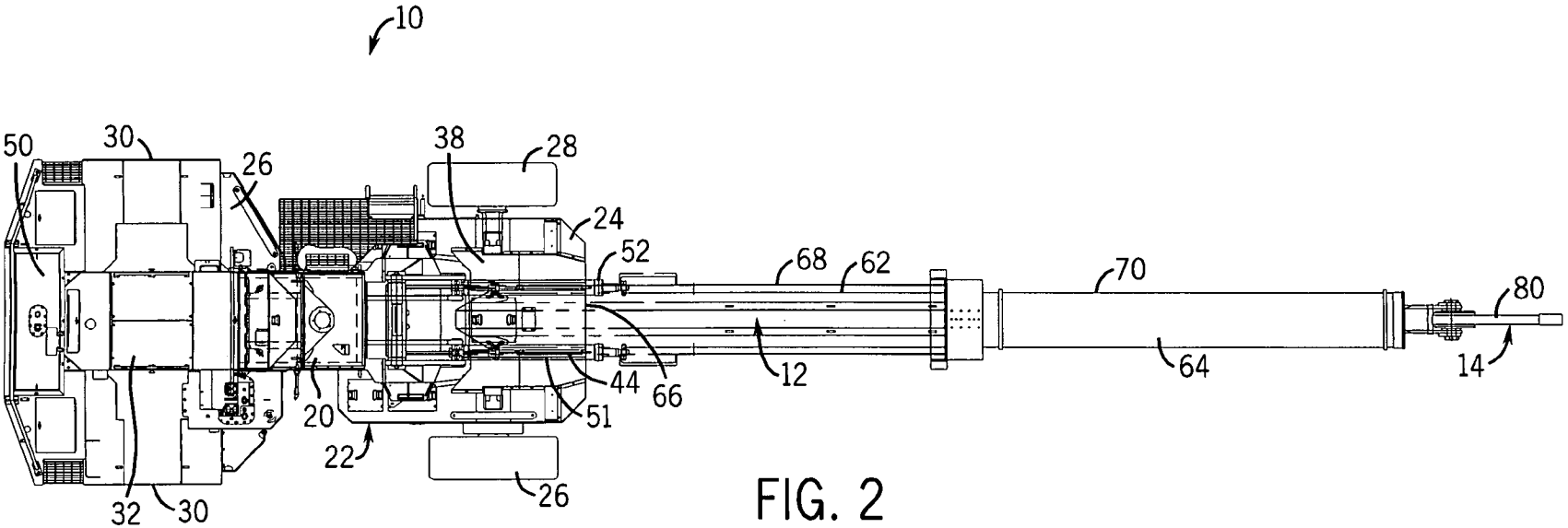
FIG. 2 is a top plan view of the mine scaling vehicle of FIG. 1.

Referring to FIGS. 1 and 2, there is shown a mine scaling vehicle 10 provided by the present invention. The mine scaling vehicle 10 includes a boom 12 carrying a scaling tool 14. The scaling tool is adapted for use in removing loose materials, such as scale 16, from mine ceilings 18 and walls in underground mines for mine safety. The mine scaling vehicle 10 further includes an operator's cab 20 from which an operator of the mine scaling vehicle controls the operation of the mine scaling vehicle and the scaling tool 14 during scaling removal operations.

The mine scaling vehicle 10 has an articulated frame 22 to enhance maneuverability of the mine scaling vehicle 10, particularly in mine cavities. The articulated frame 22 includes a front or boom end frame section 24 and a rear or engine end frame section 26. The articulated frame 22 is supported for movement on the terrain by any suitable means, such as a wheeled drive system including front wheels 28 and rear wheels 30, which can be rubber tires, for example, a crawler mechanism, a half-track mechanism, or any other suitable transport mechanism.

The mine scaling vehicle 10 illustrated in FIGS. 1 and 2 is a four-wheel drive vehicle having the drive system 32 for the vehicle carried by the rear frame section 26. The drive system 32 can include an engine, a drive train that couples the engine to the drive wheels, and a power source such as battery, for example. The vehicle drive and steering controls are located within the operator's cab 20.

Figure 3:
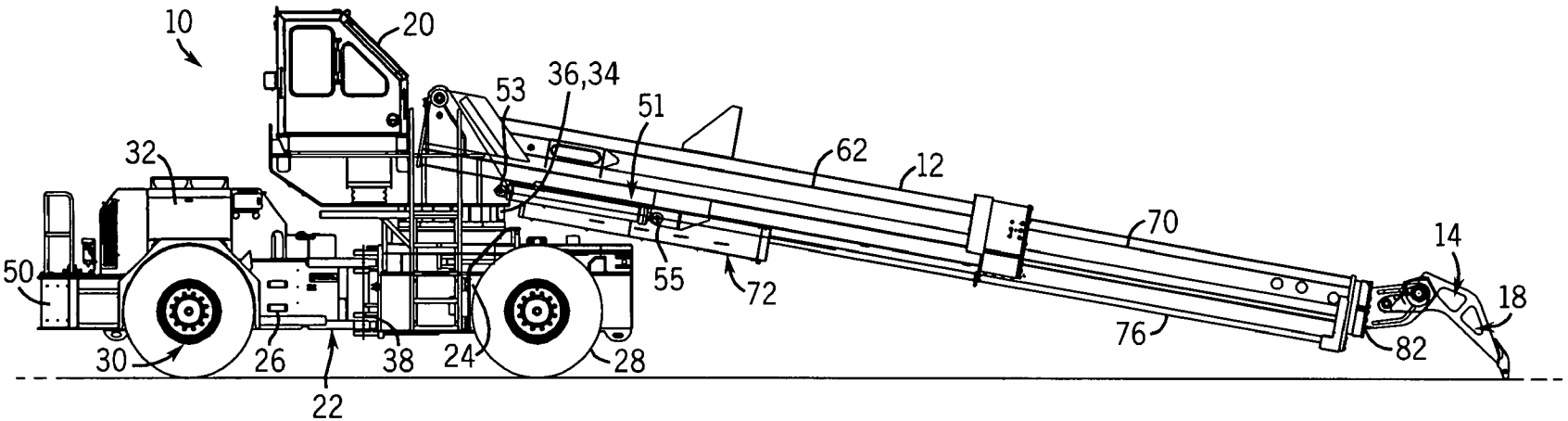
FIG. 3 is a side elevation view of the mine scaling vehicle with the boom shown in a lowered position.

Referring also to FIG. 3, the boom 12 and the operator's cab 20 are carried by a rotatable support or turntable 34 that is mounted on the front frame section 24 to revolve in a horizontal plane about a vertical axis. The turntable 34 includes a simple, hydraulically actuated swing mechanism 36 that allows rotation of the boom 12 and the operator's cab 20 relative to the vehicle frame 22. The boom 12 is pivotally coupled to the forward end of the turntable 34 and is adapted to be hydraulically operated between raised and lowered positions and to have telescoping booms sections extended and retracted, allowing the operator to position the scaling tool 14 where it is needed. Hydraulic actuators associated with the boom 12 and the turntable 34 are operated by a hydraulic control system 38 that is carried by the front frame section 24 of the mine scaling vehicle 10. The major components of the hydraulic control system 38 can include hydraulic control devices, a hydraulic fluid reservoir, and a hydraulic pump, for example, which are collectively indicated by reference numeral 38.

Considering the mine scaling vehicle 10 in more detail, with reference to FIGS. 1-3, the major components of the mine scaling vehicle 10 including the articulated frame 22, the vehicle drive system 32 and the hydraulic control system 38 form the "base" of the mine scaling vehicle 10. The "base" of the mine scaling vehicle 10 supports the "operating" portion of the mine scaling vehicle, including the boom 12 and the operator's cab 20. In accordance with one aspect of the invention, only the boom 12 and the operator's cab 20 are rotated with the turntable 34. The major components of the drive system 32 and of the hydraulic control system 38, for the most part, are located at or below beneath the plane of the turntable 34, such that the mine scaling vehicle 10 has a low center of gravity. The "base" of the mine scaling vehicle 10 is static because the major components do not rotate. Moreover, the "base" of the mine scaling vehicle 10 serves as a counterweight for the mine scaling vehicle. However, the mine scaling vehicle 10 can include a further counterweight 50 mounted to the rearward end of the rear frame section.

Figure 5:
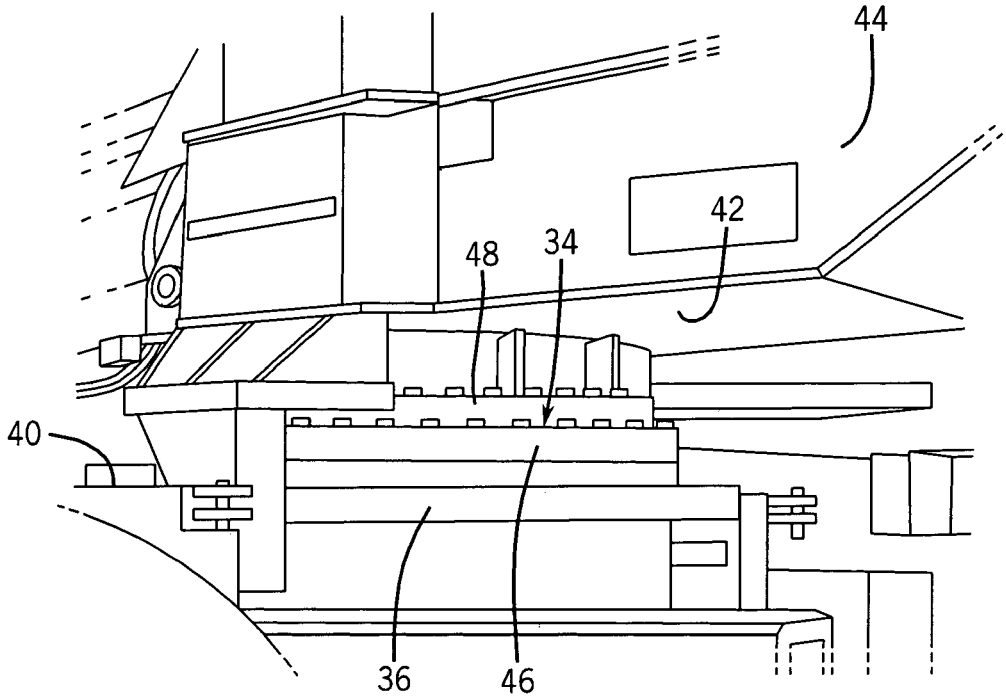
FIG. 5 is a fragmentary view showing the swing mechanism of the mine scaling vehicle of FIG. 1.
Figure 15:
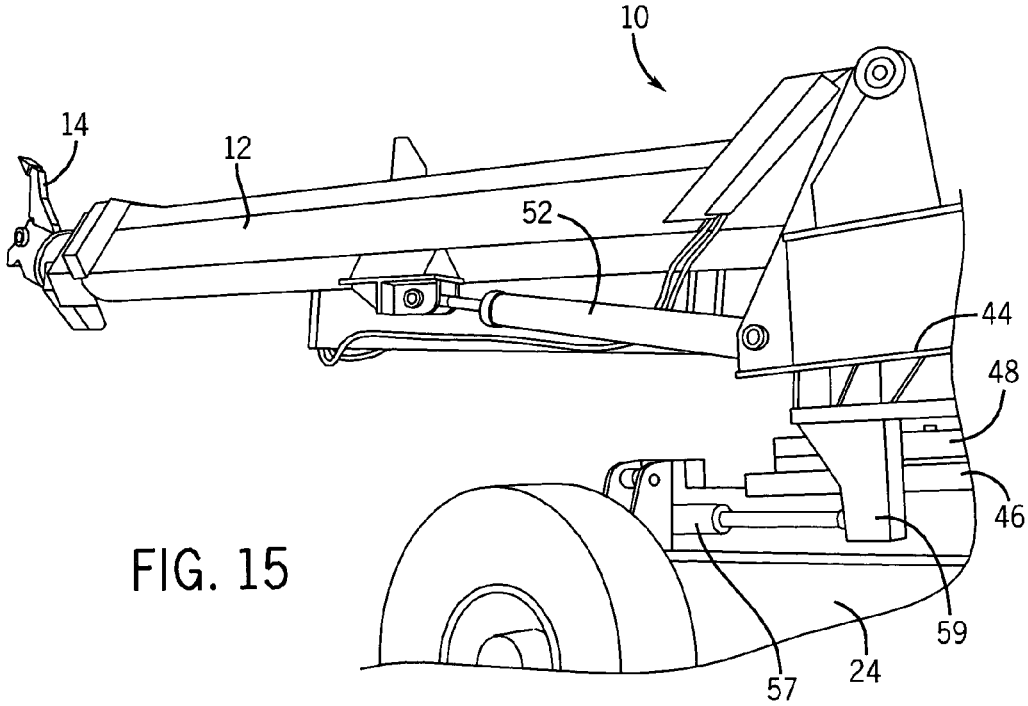
FIG. 15 is a fragmentary view in perspective of the front frame section of the mine scaling vehicle and showing a swing mechanism of a turntable of the mine scaling vehicle.
Figure 16:
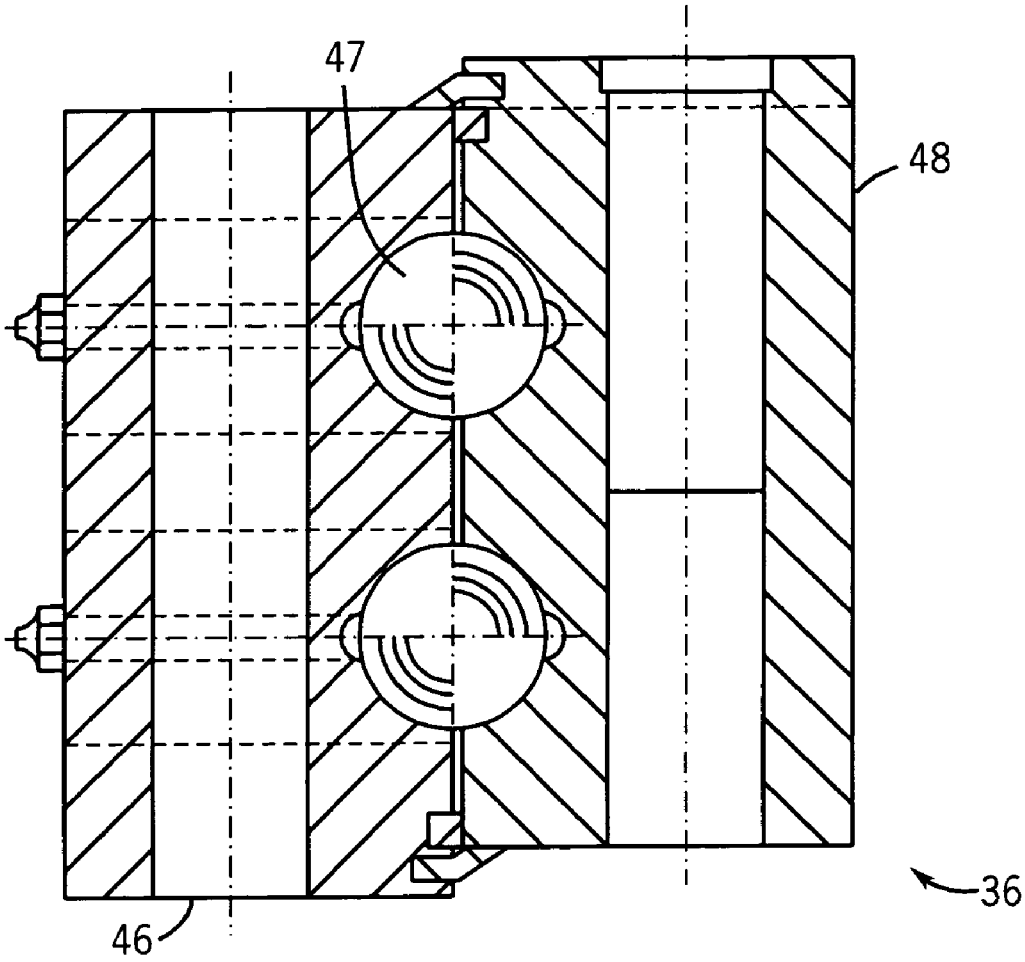
FIG. 16 is a sectional view of a portion of the swing mechanism of the mine scaling vehicle.

Referring also to FIGS. 5, 15 and 16, the swing mechanism 36 of the turntable 34 of the mine scaling vehicle 10 is interposed between the upper surface 40 of the front frame section 24 and the undersurface 42 of a support frame 44 for the operator's cab 20. The swing mechanism 36 can be a commercially available unit that includes an outer ring 46 and a mating inner ring 48 which define outer and inner ball bearing races, for ball bearings 47 shown in FIG. 16. The outer ring 46 is mounted on the upper surface 40 of the front frame section 24. The inner ring 48 is fixed to the undersurface 42 of the operator's cab support frame 44. The turntable preferably is rotated through the use of two hydraulic cylinders, such as hydraulic cylinder 57 shown in FIG. 15, which are connected between an upright 58 carried by the front frame section 24 and depending arms, such as arm 59, of the support frame 44 for the operator's cab 20. Alternatively, the inner ring 48 can define a gear (not shown) that is coupled to a drive mechanism for rotating the support frame 44 and the operator's cab 20 and the boom 12 carried thereby.

Figure 4:
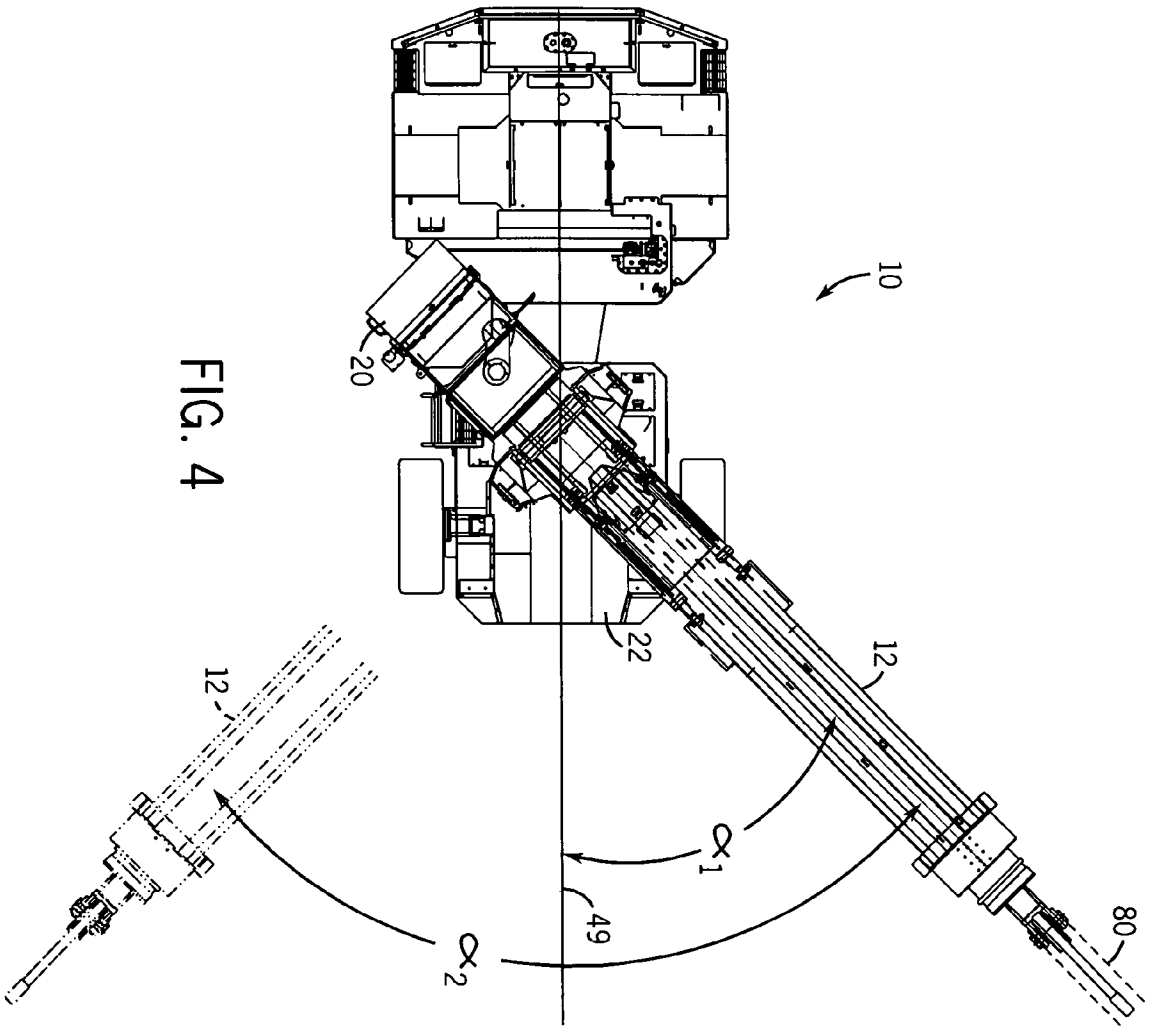
FIG. 4 is a top plan view of the mine scaling vehicle of FIG. 1 with the boom shown rotated in one direction to an end position, with the boom shown in phantom for the opposite end position.

Referring to FIGS. 3 and 4, the turntable 34 allows rotation of the boom 12 and the operator's cab 20 an angular distance $\alpha_1$ to the left from the centerline 49 of the vehicle frame 22 as shown by the solid line in FIG. 4 and an angular distance $\alpha_2$ to the right from the centerline 49, as shown in phantom in FIG. 4. In one embodiment, $\alpha_1$ and $\alpha_2$ are both 45°. An additional 30° of swing for the boom 12, 15° on each side of the machine centerline 49, can be obtained through machine articulation.

The boom 12 is shown in a centered position in FIG. 2 and is rotatable along with the turntable 34 between left and right positions as shown in FIG. 4. By way of example, for a boom 12 of a length that provides a reach of approximately 48.5 feet with the boom fully extended, the end of the boom 12 can be rotated through an arcuate extent of approximately sixty-three feet (and an arcuate extent of forty-one feet with the boom fully retracted).

Referring to FIGS. 1, 2, 6 and 8, the boom 12 is formed by non-rotating, telescoping beams 62 and 64. The beams 62 and 64 are hollow, generally triangular in cross section. The beam 62 has one end 66 pivotally secured to the support frame 44. The other beam 64 is a boom extension that is dimensioned to be received telescopically within the beam 62. Beam 62 is a fixed boom section 68 (FIG. 2) and beam section or boom extension 64 is a movable boom section 70.

The boom 12 is pivotably mounted to the forward end of the operator's cab support frame 44 for movement between a lowered position, as shown in FIG. 3 and raised positions, such as the position shown in FIG. 1. The boom 12 can have a reach of approximately 48.5 feet. Raising and lowering of the boom 12 is controlled by a pair of hydraulic actuators 51,52 which are located on opposite sides of the boom 12. The hydraulic actuator 51 (FIG. 3) has a rod cylinder 53 connected to the support frame 44 and a rod end 55 pivotally connected to the underside of the boom 12. The hydraulic actuator 52 (FIG. 1) has a rod cylinder 54 connected to the support frame 44 and a rod end 56 pivotally connected to the underside of the boom 12. The hydraulic actuators 51,52 are connected to the hydraulic control system 38 by hydraulic lines (not shown) located at the front end of the support frame 44.

Figure 6:
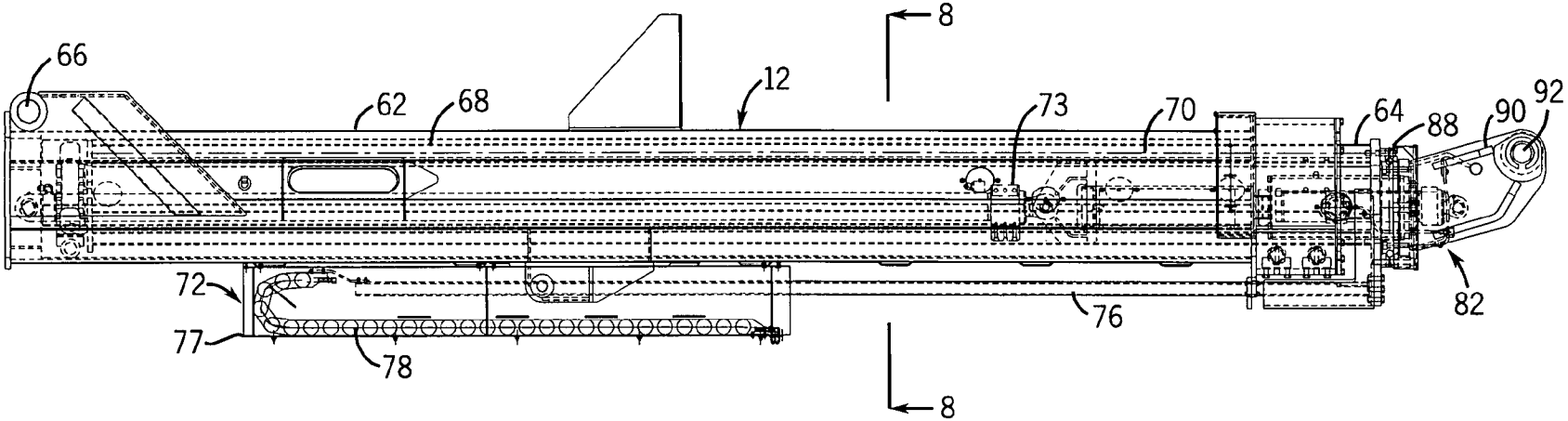
FIG. 6 is a side elevation view of the boom assembly of the mine scaling vehicle of FIG. 1 and showing the hose box.
Figure 8:
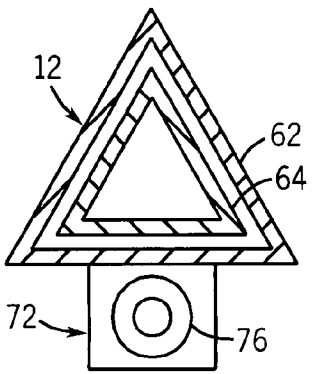
FIG. 8 is a sectional view of the boom of the mine scaling vehicle taken along the line 8-8 of FIG. 6.
Figure 11:
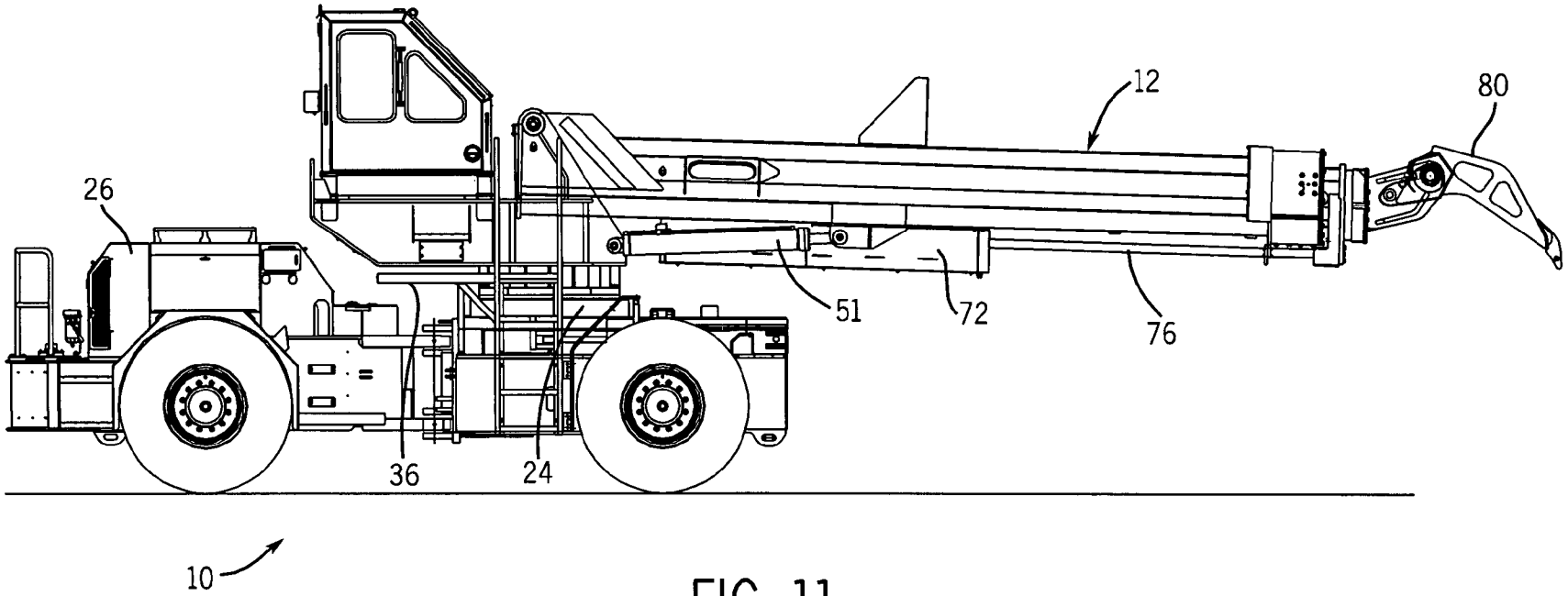
FIG. 11 is a side view of the mine scaling vehicle with the energy chain shown retracted.
Figure 12:
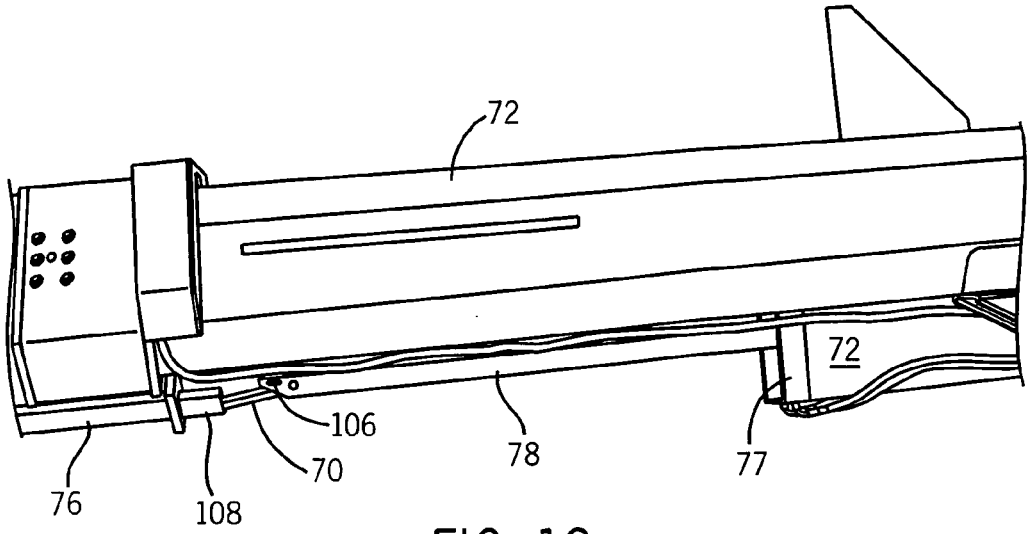
FIG. 12 is a side view of the front end of the boom of the mine scaling vehicle with the energy chain shown extended.

Referring to FIGS. 3, 6 and 8, a further hydraulic control mechanism 73 (FIG. 6) is controllable by the operator to reciprocate the movable boom section 70 with respect to the fixed boom section 68 between a fully retracted position, shown in FIG. 4 and a fully extended position shown in FIG. 1, 2 or 3. The hydraulic control mechanism 73 for the movable boom section 70 can be located within the beam 62 or carried on the underside of the fixed boom section 68.

Referring to FIGS. 1, 3 and 6, the scaling tool 14 can be a pick 80 that is mounted to the end of the boom 12. The pick 80 can be of conventional design and is mounted to the forward end of the boom extension or movable boom section 70 by a barrel assembly 82. However, other types of tools can be mounted to the boom 12.

Figure 9:
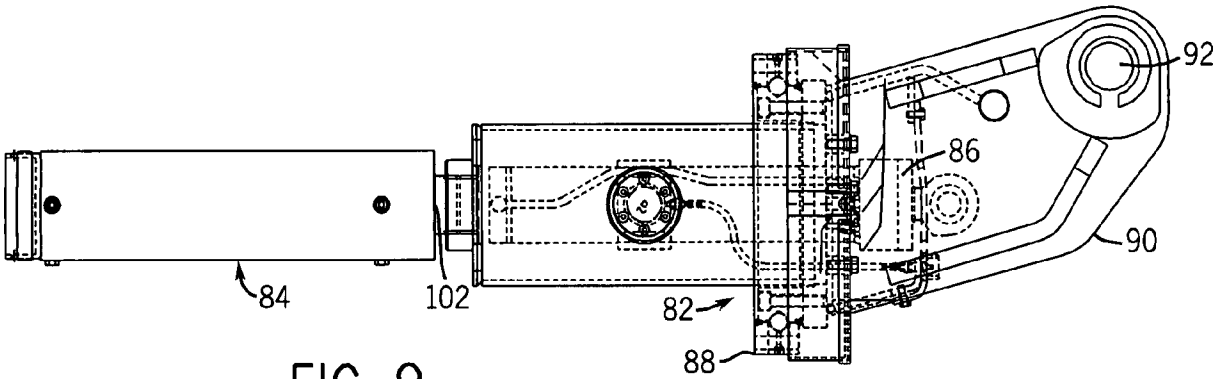
FIG. 9 is an enlarged view of the barrel assembly of the boom assembly of FIG. 6.
Figure 10:
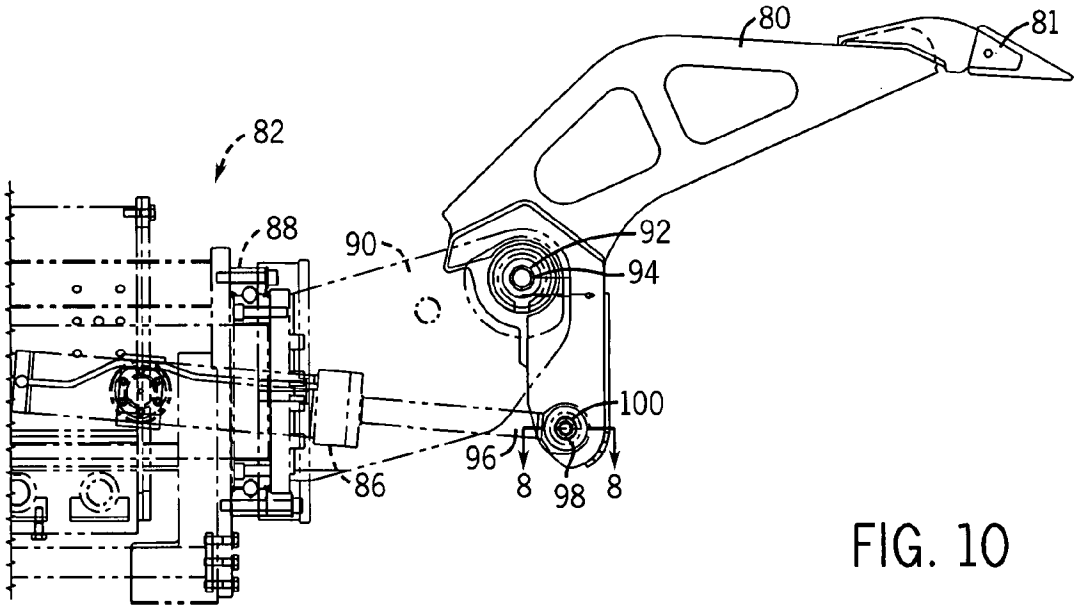
FIG. 10 is a side view of the pick with a portion of the barrel assembly shown in phantom.

Referring also to FIGS. 9 and 10, barrel assembly 82 supports the pick 80 for rotation about the axis of the boom 12 and for tilting movement upwardly and downwardly relative to the axis of the boom 12. The pick 80 is rotated by a hydraulically operated rotary actuator 84, shown in FIG. 9, that is coupled to the barrel assembly 82. The pick 80 is tilted by a hydraulically operated tool cylinder 86 of the barrel assembly 82, shown in FIG. 10.

Referring to FIGS. 6, 9 and 10, the barrel assembly 82 is mounted in the open end of the movable boom section 70. The barrel assembly 82 is coupled to the end of the inner movable boom section 70 by a rotation bearing 88. The barrel assembly 82 includes a tool mount 90, including a pivot aperture 92, to which the pick 80 is pivotably mounted by a pivot pin 94 (FIG. 10). The rod end 96 of the tool cylinder 86 is coupled to a further pivot aperture 98 of the pick 80 by a pivot pin 100. The tool cylinder 86 is hydraulically operable to pivot the pick 80 about a pivot axis defined by pivot pin 94, to move the tip 81 of the pick 80 forward and backward. The rotary actuator 84 and the tool cylinder 86 can be of conventional design.

The rotary actuator 84 is mounted inside the end of the movable boom section 70. The rotary actuator 84 has a splined rotating end 102 (FIG. 9) that is coupled to the barrel assembly 82 for rotating the barrel assembly 82 and thus the pick 80. As is stated above, the pick is rotatable over a range of 270°.

Figure 13:
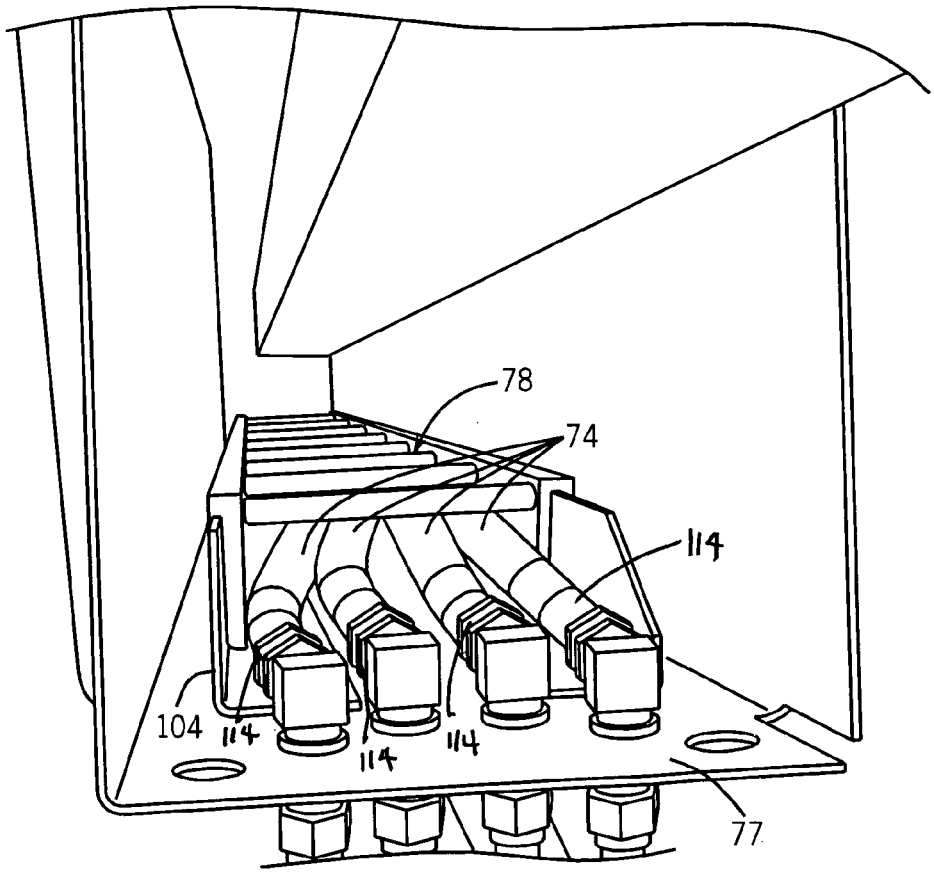
FIG. 13 is an end view of the hose tray assembly showing the hoses and the energy chain.
Figure 14:
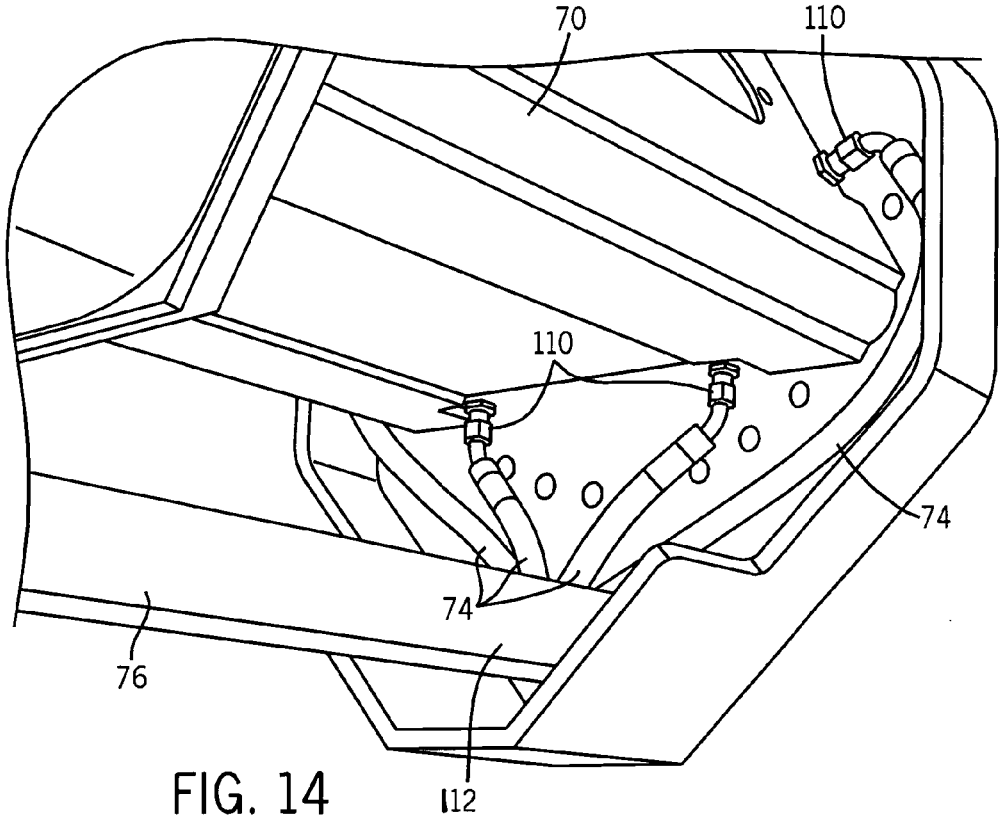
FIG. 14 is a perspective view of the front end of the boom showing the hoses connected to the barrel assembly.

Referring to FIGS. 3, 6, 11 and 12, a hose tray assembly 72 and a hollow hose tube 76 route hoses 74 (FIG. 12) from the machine to the rotary actuator 84 (FIG. 9) and the tool cylinder 86 for supplying hydraulic fluid for operating the rotary actuator 84 and the tool cylinder 86. The hose tray assembly 72 and the hose tube 76 extend along the lower side of the boom 12. More specifically, with reference to FIGS. 1, 6, and 11-14, the hose tray assembly 72 includes a hose tray 77 that contains a mechanism 78, commonly referred to as an energy chain. The energy chain 78 has one end 104 coupled to the hose tray 77. The other end 106 (FIG. 12) of the energy chain 78 is coupled to one end 108 of the hollow hose tube 76 for coupling the hoses 74 between the vehicle and the forward end of the boom 12. The forward end of the boom 12 is provided with hose connections 110 (FIG. 14) by which the hoses 74 are connected to the rotary actuator 84 and to the tool cylinder 86 (FIG. 9). The other end 112 of the hose tube 76 is coupled to the inner or movable boom 70. The hoses 74 extend within the energy chain 78 as shown in FIG. 13, for example. The ends 114 (FIG. 13) of the hoses 74 are connected to the source of hydraulic fluid for the mine scaling vehicle 10. The hose tray assembly 72 and the hose tube 76 extend and retract with the inner boom assembly to provide a hose (oil) transfer system.

Figure 7:
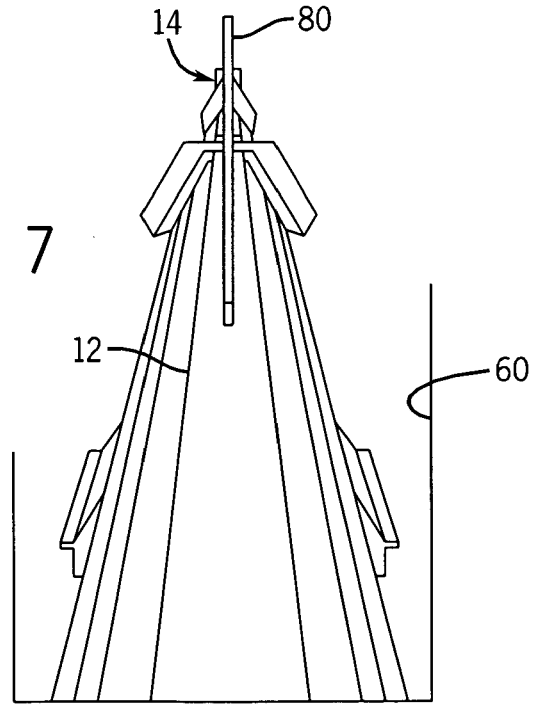
FIG. 7 is a view of the boom and the scaling tool as seen through the front window of the operator's cab side of the mine scaling vehicle of FIG. 1.

Referring to FIGS. 2, 3 and 7, in accordance with a further aspect of the invention, the operator's cab 20 is mounted on the turntable 34 located directly rearwardly of the boom 12. Locating the operator's cab 20 centered behind the boom 12 affords improved visibility of the scaling tool 14 through the front window 60 of the cab 20. Locating the operator's cab 20 also improves operator comfort in operation of the mine scaling vehicle 10. FIG. 7 is a view of the pick 80 seen through the front window 60 of the operator's cab 20 with the boom 12 in a raised position.

It may therefore be appreciated from the above detailed description of the preferred embodiment of the present invention that it provides a mine scaling vehicle that includes a turntable including simple swing mechanism for rotating the boom and the operator's cab. Only the boom and the operator's cab are rotated with the turntable. Other major machine components, such as the engine, the transmission, the operating and supply components of the hydraulic system, etc. remain static. Because these major components are located at or below beneath the plane of the turntable, the mine scaling vehicle has a low center of gravity, such that the mine scaling vehicle is easier and safer to operate. In addition, the operator's cab is located centered directly rearwardly of the boom. Locating the operator's cab centered behind the boom affords improved visibility of the pick through the front window of the cab. Locating the operator's cab also improves operator comfort in operation of the mine scaling vehicle.

Although an exemplary embodiment of the present invention has been shown and described with reference to particular embodiments and applications thereof, it will be apparent to those having ordinary skill in the art that a number of changes, modifications, or alterations to the invention as described herein may be made, none of which depart from the spirit or scope of the present invention. All such changes, modifications, and alterations should therefore be seen as being within the scope of the present invention.

What is claimed is:

1. A mine scaling vehicle comprising:

a frame, wherein the frame is articulated and includes a front frame section and a rear frame section;

a turntable mounted on the front frame section;

a boom coupled to the turntable and rotatable with the turntable;

a tool coupled to the boom;

a cab from which an operator controls the operation of the mine scaling vehicle and the tool, the cab mounted on the turntable and rotatable with the turntable, wherein the cab is located centered rearwardly of the boom to improve scaling visibility for the operator, wherein operating and supply components of a hydraulic control system are carried by the front frame section and a drive system for the vehicle is carried by the rear frame section; and a drive mechanism for rotating the turntable, the cab and the boom relative to the frame through angular distances to the left and right of a centerline of the vehicle frame, the drive mechanism including first and second hydraulic actuators coupled between the front portion of the frame and the cab, an additional swing for the boom on either side of the machine centerline being obtainable through articulation of the vehicle.

2. The mine scaling vehicle of claim 1, wherein the cab is rotatable, with vehicle articulation, over an arcuate range of about 120° relative to the frame.

3. The mine scaling vehicle of claim 1, wherein the cab is rotatable, with vehicle articulation, over an arcuate range of between about ±45° and ±60° on either side of a centerline of the mine scaling vehicle.

4. The mine scaling vehicle of claim 1, wherein the turntable includes a swing mechanism including an outer ring and a mating inner ring which define a bearing race, the hydraulic control system including at least one hydraulic control device coupled to the cab for rotating the cab and boom relative to the frame.

5. The mine scaling vehicle of claim 4, wherein one of said rings is mounted on an upper surface of the front frame section and the other one of said rings is coupled to an under surface of the cab.

6. The mine scaling vehicle of claim 1, wherein the drive system is mounted on the rear frame section and said operating and supply components of the hydraulic control system are mounted on the front frame section, said drive system and said hydraulic control system located below a plane of the turntable to provide a low center of gravity for the mine scaling vehicle.

7. A mine scaling vehicle comprising:

a mine scaling vehicle having an articulated frame with a front portion and a rear portion;

a hydraulic control system, the hydraulic control system including operating and supply components carried by the front portion;

a turntable mounted on the front portion;

a boom pivotally coupled to the turntable and rotatable with the turntable;

a tool coupled to the boom, a cab from which an operator controls the operation of the mine scaling vehicle and the tool, the cab mounted on the turntable and rotatable with the turntable; the hydraulic control system including at least one hydraulic control device coupled to the cab for rotating the cab and the boom relative to the frame, wherein the hydraulic control system is located below a plane of the turntable and at a level of wheels of a drive system for the mine scaling vehicle; and a drive mechanism for rotating the turntable, the cab and the boom relative to the frame through angular distances to the left and right of a centerline of the vehicle frame, the drive mechanism including first and second hydraulic actuators coupled between the front portion of the frame and the cab, an additional swing for the boom on either side of the machine centerline being obtainable through articulation of the vehicle.

8. The mine scaling vehicle of claim 7, wherein the turntable includes a swing mechanism including an outer ring and a mating inner ring which define a bearing race.

9. The mine scaling vehicle of claim 8, wherein one of said rings is mounted on an upper surface of the frame and the other one of said rings is coupled to an under surface of the cab.

10. The mine scaling vehicle of claim 8, wherein the cab is rotatable, with vehicle articulation, over an arcuate range of about 120°.

11. The mine scaling vehicle of claim 8, wherein the cab is rotatable, with vehicle articulation, over an arcuate range of between about ±45° and ±60° on either side of a centerline of the mine scaling vehicle.

12. A mine scaling vehicle comprising:

a mobile articulated frame supported for movement by a transport mechanism, the frame including a front frame section and a rear frame section;

a drive system coupled to the transport mechanism for moving the vehicle;

a turntable mounted on the front frame section, the turntable including a swing mechanism for rotating the cab relative to the frame;

a boom pivotally coupled to the turntable and rotatable with the turntable;

a tool coupled to the boom;

a cab from which an operator controls the operation of the mine scaling vehicle and the tool, the cab mounted on the turntable and rotatable with the turntable; and a hydraulic control system including at least one hydraulic actuator coupled between the frame and cab for rotating the turntable, the cab and the boom relative to the frame, the hydraulic actuator interposed between the front frame section and the cab for rotating the turntable, the cab and the boom through angular distances to the left and right of a centerline of the vehicle frame, an additional swing for the boom on either side of the machine centerline being obtainable through articulation of the vehicle;

wherein the drive system is carried by the frame and wherein the hydraulic control system is carried by the front frame section and is located at a level of wheels of the drive system to provide a low center of gravity for the mine scaling vehicle.

13. The mine scaling vehicle of claim 12, wherein the drive system is mounted on the frame located below a plane of the turntable.

14. The mine scaling vehicle of claim 13, wherein the drive system is mounted on the rear frame section.

15. The mine scaling vehicle of claim 12, further including a counterweight mounted to the rear frame section.

16. A mine scaling vehicle for use in scaling and flaking operations involved with the removal of loose materials from mine ceilings and walls in underground mines, said mine scaling vehicle comprising:

a mobile articulated frame supported for movement by a transport mechanism;

a drive system mounted on a rear portion of the frame and coupled to the transport mechanism for moving the vehicle;

a turntable mounted on a front portion of the frame;

a telescoping boom pivotally coupled to the turntable and rotatable with the turntable;

a scaling tool coupled to the boom, the scaling tool adapted for use in removing loose materials, such as scale, from mine ceilings and walls;

a cab from which an operator controls the operation of the mine scaling vehicle and the tool, the cab mounted on the turntable and rotatable with the turntable the turntable including a swing mechanism for rotating the cab relative to the frame; and a hydraulic control system including at least one hydraulic actuator coupled between the frame and cab for rotating the turntable, the cab and the boom relative to the frame, said hydraulic actuator interposed between the front portion of the frame and the turntable for rotating the turntable, the cab and the boom through angular distances to the left and right of a centerline of the vehicle frame, an additional swing for the boom on either side of the machine centerline being obtainable through articulation of the vehicle, wherein the hydraulic control system is carried by the front portion of the frame to provide a low center of gravity for the mine scaling vehicle and provides power for advancing and retracting the telescoping boom.

17. The mine scaling vehicle of claim 16, wherein the telescoping boom comprises at least two beams having a generally triangular cross-section.

18. The mine scaling vehicle of claim 16, wherein the telescoping boom comprises at least two beams that extend or retract linearly.

* * * * *